United States Patent [19]

Igata et al.

[11] Patent Number: 4,761,265

[45] Date of Patent: Aug. 2, 1988

[54] SPRING COPPER ALLOY FOR ELECTRIC AND ELECTRONIC PARTS

[75] Inventors: Naohiro Igata, 15-1, Nishiogi-Kita 1-Chome, Suginami-Ku, Tokyo; Yoshio Nakasato, Tokyo, both of Japan

[73] Assignees: Nakasato Limited; Naohiro Igata, both of Tokyo, Japan

[21] Appl. No.: 96,801

[22] Filed: Sep. 10, 1987

[30] Foreign Application Priority Data

Jan. 8, 1986 [JP] Japan ..... 61-793

[51] Int. Cl.[4] ..... C22C 9/02; C22C 9/06

[52] U.S. Cl. ..... 420/472; 420/473; 148/2; 148/412

[58] Field of Search ..... 420/472, 473; 148/412, 148/414, 433, 435, 2

[56] References Cited

U.S. PATENT DOCUMENTS

| | | | |
|---|---|---|---|
| 2,155,407 | 4/1939 | Crampton et al. | 148/433 |
| 4,169,729 | 10/1979 | Popplewell et al. | 420/473 |
| 4,337,089 | 6/1982 | Arita et al. | 148/2 |

*Primary Examiner*—L. Dewayne Rutledge
*Assistant Examiner*—George Wyszomierski
*Attorney, Agent, or Firm*—Stevens, Davis, Miller & Mosher

[57] ABSTRACT

A spring copper alloy for electric and electronic parts having a high modulus of elasticity, a good electrical conductivity and a good solderability is disclosed, which alloy consists of 1.5~3.0% by weight of Ni, 1.2~2.0% by weight of Sn, 0.05~0.30% by weight of Mn, 0.01~0.1% by weight of P, inevitable impurities and the remainder of Cu.

2 Claims, No Drawings

SPRING COPPER ALLOY FOR ELECTRIC AND ELECTRONIC PARTS

This application is a continuation of application Ser. No. 821,345, filed Jan. 22, 1986, now abandoned.

BACKGROUND OF THE INVENTION

1. Field of the Invention

The present invention relates to a spring copper alloy for electric and electronic parts having a high modulus of elasticity, a good electrical conductivity, a good spring limit value and a good solderability, and which can be produced in an inexpensive manner.

2. Related Art Statement

Heretofore, as a spring copper alloy for electric and electronic parts, there has been well-known a phosphor bronze such as JIS C-5191 alloy (5.5~7.0% by weight of Sn, 0.03~0.35% by weight of P and the remainder of Cu) and JIS C-5210 alloy (7.0~9.0% by weight of Sn, 0.03~0.35% by weight of P and the remainder of Cu).

However, the spring copper alloys mentioned above cannot satisfy the high modulus of elasticity and the good electrical conductivity now required for miniaturized electric and electronic devices operative at high frequencies. Moreover, since a 5~8% by weight of Sn content results an intermetallic growth when heated at 100°~150° C. soldering, solderability is lessened. Also, a large increase in Sn content causes a high material cost.

SUMMARY OF THE INVENTION

The present invention has for its object to eliminate the drawbacks mentioned above and to provide a spring copper alloy for electric and electronic parts having a high modulus of elasticity, a better electrical conductivity, a good spring limit value in bending and a good solderability, and which can be produced in an inexpensive manner.

According to the invention, a spring copper alloy for electric and electronic parts having a high modulus of elasticity, a good electrical conductivity and a good solderability, consists of 1.5~3.0% by weight of Ni, 1.0~2.0% by weight of Sn, 0.05~0.30% by weight of Mn, 0.01~0.1% by weight of P, inevitable impurities and the remainder of Cu.

DESCRIPTION OF THE PREFERRED EMBODIMENTS

A spring material according to the invention is manufactured in the following manner. About 2 kg of raw materials are supplied to a crucible made of graphite, and are melted in argon atmosphere at a temperature of for example 1,210° C. by means of a high frequency induction furnace to obtain a molten alloy consisting of 1.5% by weight of Ni, 1.0% by weight of Sn, 0.1% by weight of Mn, 0.05% by weight of P, inevitable impurities and the remainder of Cu. The molten alloy, at a temperature of about 1,150° C., is cast in a stainless steel mold to obtain a slab having a thickness of 150 mm. The slab thus obtained is annealed at about 800° C., and is then subjected to hot rolling to obtain a slab having a thickness of 12 mm. The slab of 12 mm is faced off, and is then subjected to cold rolling to obtain a specimen having a thickness of 1.1 mm. The specimen after cold rolling is further annealed at about 600° C., and is then rolled down to 0.3 mm. The finally rolled specimen is further annealed at a temperature of about 250° C. for less than one hour and is air-cooled to obtain the spring copper alloy having a stable structure.

The spring copper alloy produced in the manner described above has the characteristics described below.

| | |
|---|---|
| Tensile strength | 60 kg/mm$^2$ (86 KSI) |
| Elongation | 8% |
| Minimum 90° bend ratio (R/T) | |
| Long | 0 |
| Transverse | 1 |
| Modulus of elasticity | 13,000 kg/mm$^2$ (18.5 × 10$^6$ psi) |
| Electrical conductivity | 35 IACS % |
| Bending spring limit (Kb) | 50 kg/mm$^2$ (71 KSI) |
| Vickers hardness (Hv) | 180 |

In this case, the spring copper alloy described above has the lowest contents of Sn and Ni available in the claimed range of this invention, so that respective characteristics except for the electrical conductivity show the lowest values.

MECHANISMS

As mentioned above, the spring copper alloy having the high modulus of elasticity, good electrical conductivity, good spring limit value and good solderability can be obtained by decreasing an amount of Sn largely as 1.0~2.0% by weight with respect to the known phosphor alloy and by adding Ni and Mn.

Generally, comparison factors of properties between metals are tensile strength; yield stress at 0.2% offset; elongation; bending; vickers hardness; and electrical conductivity, as shown in, for example, in "Sampling the new copper alloys", DESIGN ENGINEERING issued on August, 1981. However, ultimate tensile strength, 0.2% offset yield strength and elongation cannot be design parameters for designers of users of materials, because the material should be used below its spring limit. Ultimate tensile strength and 0.2% offset yield strength are not always proportional to the spring limit and spring limit in bending. Depending on the micro-structure of the material. Moreover, elongation is related to bendability in the same alloy but not in different alloys. The evaluation of the alloy (IG-120) according to the invention in comparison with phosphor bronze is shown in Table 1

TABLE 1

| | Property Measured | Related Characteristic | Evaluation of IG-120 |
|---|---|---|---|
| 1 | Electrical and thermal conductivity | Temperature rise and electrical resistance increase in operation | MB |
| 2 | Elastic modulus in bending | Contact force or spring force | MB |
| 3 | Elastic limit in bending | Micro yield load | B |
| 4 | Tensile strength | Torsional strength | E |
| 5 | Stress relaxation resistance | Creep resistance | B |
| 6 | Fatigue strength | Spring life under cyclic stress | E |
| 7 | Thermal softening resistance | Permissible operating temperature | B |
| 8 | Residual stress by rolling and stamping | Distortion, deformation and stress relaxation | B |
| 9 | Tolerance of thickness | Precision in shape | B |
| 10 | Oxidation resistance and character of surface film | Platability adhesion between contact material and spring material | B |
| 11 | Intermetallic growth | Solderability | B |
| 12 | Minimum bending radius | Formability | E |

TABLE 1-continued

| Property Measured | Related Characteristic | Evaluation of IG-120 |
|---|---|---|
| in "bad way" bend | | |
| 13 Material cost, processing cost and salable price of supply back scrap | Cost competition | MB |

Note:
In evaluation of IG-120 in comparison with phosphor bronze, MB means much better, B means better and E means equal level.

In the spring copper alloy according to the invention, the reasons for limiting an amount of Ni and Sn are as follows. The addition of Ni increases the modulus of elasticity, strength and corrosion resistivity, but the addition of excess Ni makes the electrical conductivity lower, so that an amount of Ni added is limited to 1.5~3.0% by weight. The improvement in corrosion resistivity relates to the improvements in transportability, storageability, platability and solderability. The addition of Sn decreases solderability, and the amount of Sn added is limited to 1.0~2.0% by weight.

MEASUREMENT METHOD

The methods of measuring various characteristics of the spring copper alloy and the results of those measurements will be explained.

1. Measurement of Young's modulus (elasticity)

The amount of flexure or displacement of a cantilever specimen is measured under the condition that a weight (50 g) is set at a position, the distance of which is one hundred times of thickness of specimen from the supporting position. Then, Young's modulus is obtained from the equation below dependent on the measured flexure amount.

$$E = \frac{4W}{bf} \times \frac{L^3}{t}$$

where E: Young's modulus (kg/mm$^2$), W: weight (0.015 kg), L: length of specimen (mm), f: flexure displacement (mm), b: specimen width (=10 mm), t: specimen thickness (mm).

2. Measurement of spring limit value (in bending)

The spring limit value Kb is obtained from a permanent deformation $\delta$ and a moment M calculated from the permanent deformation $\delta$. Here, $$\delta = (\tfrac{1}{4} \times 10^4) \times (L^2/t)$$

where $\delta$ is the amount of flexure at $\sigma = 0.375$ (E/10$^4$) kg/mm$^2$. The moment M is obtained from the equation below dependent on the flexure amount $\delta$.

$$M = M_1 + \Delta M(\delta - \epsilon_1)/(\epsilon_2 - \epsilon_1)$$

where M: moment corresponding to the spring limit value, $M_1$: moment on $\epsilon_1$ (mm.kg), $\Delta M$: $M_2 - M_1$, $M_2$: moment on $\epsilon_2$ (mm.kg), $\epsilon_1$: maximum value among permanent flexures up to $\delta$, $\epsilon_2$: minimum value among permanent flexures above $\delta$. The spring limit value Kb is obtained from the equation below dependent on the moment M.

$$Kb = \frac{M}{Z}$$

where Z: section modulus and $Z = bt^2/6$, b: specimen width (mm), t: specimen thickness (mm).

3. Measurement of hardness

Using a micro vickers hardness tester, the measurement of vickers hardness is performed under the condition that the weight is 25 g.

4. Measurement of tensile strength

A tension test is performed for the specimens cut in a perpendicular and a parallel directions with respect to the rolling direction in such a manner that the specimen having a parallel portion of 0.3 mm×5 mm×20 mm is tensile tested by an instron-type tension tester using a strain rate of $4 \times 10^{-3}$ sec$^{-1}$.

5. Measurement of remaining stress

After the specimen is set to a measurement holder, it is maintained at 105° C. in a thermostat, and then a remaining stress (RS) corresponding to the holding time is obtained from the equation.

$$RS = \frac{\delta_1 - \delta_2}{\delta_1} \times 100$$

where $\delta_1$ is an applied deformation and $\delta_2$ is a remaining deformation after eliminating the deformation.

6. Measurement of electrical conductivity

Electrical resistance is measured in such a manner that a current of 1 A is flowed in a parallel portion of a specimen of 0.3 mm×10 mm×150 mm. The electrical conductivities of the spring copper alloy according to the invention are measured and indicated by IACS%: conductivity ratio with respect to a pure copper.

Table 2 below shows a comparison table between the spring copper alloy according to the invention (IG-120) and the known phosphor bronze together with some standard alloys.

TABLE 2

| Material | IG-120 | JIS C-5191 | JIS C-5210 | UNS C51000 | ASTM C52100 | UNS C72500 | DIN CuSn6 | DIN CuSn8 |
|---|---|---|---|---|---|---|---|---|
| Composition | Ni: 1.5–3.0<br>Sn: 1.0–2.0<br>Mn: 0.05–0.30<br>P: 0.01–0.1<br>Cu: balance | Sn: 5.5–7.0<br>P: 0.03–0.35<br>Cu: balance | Sn: 7.0–9.0<br>P: 0.03–0.35<br>Cu: balance | Sn: 5<br>P: 0.2<br>Cu: 94.8 | Sn: 7.0–9.0<br>Zn: ≦0.20<br>Fe: ≦0.10<br>Pb: ≦0.05<br>P: 0.03–0.35 | Sn: 2.3<br>Ni: 9.5<br>Cu: 88.2 | Sn: 5.5–7.5<br>P: 0.01–0.4<br>Cu: balance | Sn: 7.5–9.0<br>P: 0.01–0.4<br>Cu: balance |
| Tensile strength | | | | | | | | |
| (kg/mm$^2$) | more than 60 | more than 60 | more than 65 | | | | 55–65 | 59–69 |
| (ksi) | | | | 76–91 | 85–100 | 68–83 | | |
| Elongation (%) | more than 8 | more than 8 | more than 8 | 4–11 | 12–30 | 2–13 | more than 8 ($A_{10}$) | more than 7 ($A_{10}$) |
| Modulus of elasticity (kg/mm$^2$) | more than | more than | more than | | | | | |

TABLE 2-continued

| Material | IG-120 | JIS C-5191 | JIS C-5210 | UNS C51000 | ASTM C52100 | UNS C72500 | DIN CuSn6 | DIN CuSn8 |
|---|---|---|---|---|---|---|---|---|
| | 13,000 | 11,000 | 10,000 | | | | | |
| ($10^6$ psi) | | | | 16 | 16 | 20 | — | — |
| Electrical conductivity (IACS %) | 25–35 | 11–13 | 10–12 | 15 | 13 | 11 | — | — |
| Spring limit value Kb (kg/mm$^2$) | more than 50 | — | more than 40 | — | — | — | — | — |
| Vickers hardness (Hv) | more than 180 | more than 170 | more than 185 | 175–205 | 190–220 | 155–185 | 180–210 | 190–220 |
| Cost (IG-120) | 100 | 130 | 150 | — | — | — | — | — |

As clearly shown in Table 2, IG-120 according to the invention possesses the high modulus of elasticity, the good electrical conductivity, the small remaining stress and the good solderability required for a spring copper alloy for electric parts. Also IG-120 is inexpensive in cost as compared with phosphor bronze to and other alloys which do not meet these requirements.

As mentioned above, according to the invention, it is possible to obtain a spring copper alloy for electric and electronic parts which possesses a high modulus of elasticity, good electrical conductivity, small remaining stress, good solderability and is inexpensive in cost.

What is claimed is:

1. A spring copper alloy for electric and electronic parts having a high modulus of elasticity, good electrical conductivity and good solderability, consisting of between 1.5 and 3.0% by weight of Ni, between 1.0 and 2.0% by weight of Sn, greater than 0.10 and up to 0.30% by weight of Mn, between 0.01 and 0.1% by weight of P, inevitable impurities and the remainder of Cu.

2. A method for preparing a spring copper alloy for electric and electronic parts having a high modulus of elasticity, good electrical conductivity and good solderability, which comprises melting a mixture consisting essentially of between 1.5 and 3.0% by weight of nickel, between 1.0 and 2.0% by weight of tin, between 0.10 and 0.30% by weight of manganese, between 0.01 and 0.1% by weight of phorphorus and the remainder copper under an inert atmosphere in a high frequency induction furnace, casting the molten mixture into a mold to form a thin slab of alloy, annealing the slab at about 800° C., hot rolling the slab to reduce its thickness, cold rolling the slab to futher reduce its thickness, further annealing the slab at about 600° C., rolling the slab to further reduce its thickness, further annealing the slab at about 250° C., and air-cooling the annealed slab.

* * * * *